US007461581B2

(12) United States Patent
Leitner-Wise

(10) Patent No.: US 7,461,581 B2
(45) Date of Patent: Dec. 9, 2008

(54) SELF-CLEANING GAS OPERATING SYSTEM FOR A FIREARM

(75) Inventor: Paul Leitner-Wise, Alexandria, VA (US)

(73) Assignee: LWRCInternational, LLC, Cambridge, MD (US)

( * ) Notice: Subject to any disclaimer, the term of this patent is extended or adjusted under 35 U.S.C. 154(b) by 133 days.

(21) Appl. No.: 11/491,141

(22) Filed: Jul. 24, 2006

(65) Prior Publication Data

US 2008/0276797 A1 Nov. 13, 2008

(51) Int. Cl.
*F41A 5/00* (2006.01)

(52) U.S. Cl. ..... 89/191.01; 89/191.02; 89/192

(58) Field of Classification Search ..... 89/179, 89/191.01, 191.02, 193, 194, 192
See application file for complete search history.

(56) References Cited

U.S. PATENT DOCUMENTS 3,618,457 A * 11/1971 Miller ..... 89/185
3,675,534 A * 7/1972 Beretta ..... 89/185
3,857,323 A * 12/1974 Ruger et al. ..... 89/191.01
3,869,961 A * 3/1975 Kawamura et al. ..... 89/191.02
4,244,273 A * 1/1981 Langendorfer et al. ..... 89/193
4,503,632 A * 3/1985 Cuevas ..... 42/1.06
4,553,469 A * 11/1985 Atchisson ..... 89/191.02
4,702,146 A * 10/1987 Ikeda et al. ..... 89/193
5,272,956 A * 12/1993 Hudson ..... 89/128
5,351,598 A * 10/1994 Schuetz ..... 89/185
5,634,288 A * 6/1997 Martel ..... 42/71.01
5,726,377 A * 3/1998 Harris et al. ..... 89/191.01
6,227,098 B1 * 5/2001 Mason ..... 89/193
6,382,073 B1 * 5/2002 Beretta ..... 89/193
6,634,274 B1 * 10/2003 Herring ..... 89/33.14
6,681,677 B2 * 1/2004 Herring ..... 89/33.14
6,722,255 B2 * 4/2004 Herring ..... 89/193
6,820,533 B2 * 11/2004 Schuerman ..... 89/190
6,848,351 B1 * 2/2005 Davies ..... 89/191.01
2003/0089014 A1 * 5/2003 Schuerman ..... 42/16
2005/0016374 A1 * 1/2005 Pescini ..... 89/191.01
2006/0065112 A1 * 3/2006 Kuczynko et al. ..... 89/193
2007/0012169 A1 * 1/2007 Gussalli Beretta ..... 89/193

* cited by examiner

*Primary Examiner*—Stephen M Johnson
*Assistant Examiner*—Daniel J Troy

(57) ABSTRACT

A self-cleaning gas operating system for a firearm having a conventional bolt carrier assembly is disclosed comprising: a nozzle assembly having a nozzle in direct communication with a port on the muzzle; said nozzle assembly nested within a piston cup having a vent, a connecting rod operationally linking the piston cup to a spring loaded operating rod which is substantially co-axial to a bolt carrier key having a striking portion, said striking portion having a concave strike face in contact with said operating rod, wherein gas discharged from a fired cartridge displaces the piston cup and causes the operating rod to strike the strike face displacing the bolt assembly.

28 Claims, 11 Drawing Sheets

22
48
50
80
46
44
200
220
42
232
231
38
A 54
234

198
196
A
44
182

191
194
192
180
190
188
186
184
A

208

214
201

214
201

204
206
202
208

201
212

201
214
208

42
234
230
232
231
236

15°
29°

SELF-CLEANING GAS OPERATING SYSTEM FOR A FIREARM

BACKGROUND

1. Field of the Invention

The present invention relates to autoloading firearms such as the M-16/AR 15 family, and more particularly, to firearms having an indirect gas operating system.

2. Background of the Invention

Most of the self-loading rifles designed during and after WWII have been gas-operated. Such systems differ from blowback and recoil systems in that the operating energy to cycle the bolt, extract spent ammunition and feed live ammunition comes from tapping expanding high-pressure gases at the barrel instead of from recoil forces. Examples include the U.S. M1 Garrand, M1A, and M1 Carbine, Simonov rifle (SKS), Automat Kalashnikov (AK), Swedish Ljungrnan, the late Eugene Stoner's AR10 and AR15 (M16), FN FAL, M60 and M249 Minimi machine guns.

Gas-operated designs vary in how the gas is tapped, and how gas energy is transferred to the bolt carrier. All of the weapons listed above, except the FAL, use rotary locking bolts which follow helical cam tracks in their carriers or receivers. In the Garrand, SKS and AK families, and most modern light to medium weight machine guns, gas impinges directly on operating rods fixed to the bolt carrier and located below or above the barrel. In the Ljungrnan and Stoner designs, a narrow steel tube carries the pressurized gas back to small operating cylinders on the bolt and carrier. In the M1 carbine and more recent designs such as Eugene Stoner's Amarlite AR-18, Australia's Leader, Singapore's Sterling-designed SAR rifle family, Korea's Daewoo rifle, and Heckler & Koch's 1998 G36, a small, low-mass tappet is the only moving part in contact with the gas. The tappet accelerates rapidly due to its low mass and imparts its momentum by striking an operating rod connected to or striking the bolt carrier.

U.S. Pat. No. 2,951,424 issued to E. M. Stoner on Sep. 6, 1960, discloses the M16 bolt and bolt carrier system and the gas operation thereof. This patent discloses a rifle utilizing a gas tube that extends from gas ports in the barrel, back into the receiver of the rifle and into a gas tube pocket or "key" attached to the bolt carrier.

U.S. Pat. No. 3,675,534, issued to P. C. Beretta on Jul. 11, 1972, discloses a gas-operated automatic rifle having a piston and stem inside a gas tube with the stem fixedly attached to the bolt carrier.

U.S. Pat. No. 4,358,986, issued to C. Giorgio on Nov. 16, 1982, discloses a gas-operated automatic rifle having a stationary piston and a segmented movable gas cylinder/operating rod assembly including a biasing spring.

U.S. Pat. No. 3,618,457, issued to A. Miller on Nov. 9, 1971, discloses a gas-operated rifle utilizing a gas-operated piston and rod assembly with the piston rod telescopically mounted over a stationary guide rod and being spring-biased.

U.S. Pat. No. 4,765,224, issued Aug. 23, 1988, to M. Morris discloses a modified M16 type of rifle utilizing an extended gas tube receiver on the bolt carrier which maintains telescopic engagement with the gas tube at all times during the firing cycle.

U.S. Pat. No. 4,475,438 to L. Sullivan, issued on Oct. 9, 1984, discloses an open-bolt gas-operated rifle with a short-stroke piston that kicks open the bolt carrier against a biasing spring, using a short-stroke piston movement.

One repeated criticism of the AR15/M-16 design is its direct gas impingement action. Propellant gas is tapped from the barrel and led through a tube backwards into the receiver of the piece, and into the bolt carrier itself. The gas pressure works against a piston which is a rearward-facing surface of the bolt. The pressure builds between that face of the bolt and the internal surfaces of the bolt carrier ('directly impinging' upon the bolt), forcing them apart. A cam translates that force into rotation of the bolt, so its lugs disengage with their mating surfaces, the bolt unlocks, and the bolt carrier can retract, carrying the bolt with it.

Users of the AR-15/M16 rifle are aware that the rifle requires a great deal of maintenance. Carbon that is vented back into the receiver from the gas tube essentially "plates" onto several portions of the bolt carrier and the interior of the receiver and after a few rounds are fired, the entire interior of the rifle is coated with a film of carbon. If allowed to build up, this carbon will eventually lead to stoppages, so the rifle must be cleaned frequently. A second problem with the AR-15 design is that the bolt carrier rides directly on the interior surface of the receiver. Because of the ever-present carbon fouling, most operators keep the bolt carrier well-lubricated, which turns it into a "dust magnet" unless the ejection port cover is kept closed at all times when the rifle is not in use. Excess dirt will cause the bolt carrier to eventually slow down and fail to fully chamber a round, which has necessitated the introduction of the "forward assist" button.

Over gassing is also a common complaint with the carbine length direct impingement action. Gas port and gas tube diameters are all based on a rifle length action which operates at a different pressure level, timing and volume.

The AR-18 solved some of the problems of the AR-15 by changing the gas system to a rod and piston arrangement that vents excess gases into the atmosphere just aft of the front sight/gas block. The piston is fixed; expanding gases drive the rod back into the bolt carrier, which rides on two fixed rods surrounded by recoil springs. The bolt carrier does not touch the interior surface of the receiver. Operating the bolt carrier on these two "action rods" gives minimum surface area for dust buildup or fouling.

Although in an indirect-impingement firearm, the operating rod moves the bolt carrier without depositing burnt-propellant crud in the receiver, the direct gas impingement system has the advantage of having fewer parts and less weight compared to a firearm that contains this gas in a cylinder up front of the receiver, and uses the pressure to move an operating rod. Long operating rods used with tappets or indirect impingement increase and spread out the moving mass, which tends to shift the point of balance when operated leading to dynamic problems.

Many previous attempts to provide a reliable gas piston system for the AR-15/M-16 weapon family system have suffered from dynamic problems related to off-center impact of the bolt carrier which causes the carrier to lift initially before moving backwards. This lift at the front of the carrier causes a corresponding dip at the rear of the carrier which causes the carrier to strike the lower receiver extension and cause excessive wear.

SUMMARY OF THE INVENTION

By redirecting the energy imparted by the operating rod to the bolt carrier by inducing a negative lift and therefore neutral transfer, the gas operating system of the present invention ensures that the bolt carrier moves only in a linear direction. This is achieved by off-setting the operating rod and modified gas key (which the operating rod strikes) by a pre-determined angle. The result is that the gas operating system of the present invention does not induce the wear characterized by previous attempts at modifying the direct gas impingement system of the AR15/M16 weapon. Although the validity of this invention was demonstrated using the AR15/M16 family of weapons, it should be understood by one of skill in the art that this invention can also be readily practiced with other autoloading weapons wherein gas energy propelling out of the barrel is harnessed to cycle the bolt.

One object of the present invention is to provide a gas operating system that is self-regulating and is usable with underpowered ammunition. The system being self regulating, vents gas volume only after enough is used to get the reciprocating parts to the velocity needed to cycle the action such that the stroke is the same despite bullet weight or powder charge.

Another object of the present invention is to provide a self-cleaning gas operating system wherein ribs or knurls on a gas nozzle assembly scrape against a gas piston cup thereby scraping burnt propellant buildup off the walls of the gas piston cup and venting it out through vent ports.

Yet another object of the invention is to provide a gas operating system that weighs the least possible and fits within the AR15 footprint or a footprint expanded to what the market will accept.

These and other objects of the invention are attained by providing a gas operating system for an autoloading firearm comprising a gas nozzle assembly; a gas piston cup; a connecting rod (also called an intermediate rod); and an operating rod assembly with captive operating spring. This is a gas operated short stroke piston system employing a pusher rod system. Instead of the usual arrangement of the piston in a fixed sleeve, the arrangement is reversed and the piston here is really the nozzle assembly fixed to the gas block, and the sleeve (piston cup) does the moving.

In terms of operation, the process starts with the ignition of cartridge liberating propellant gases and propelling the bullet down the barrel. As the bullet passes the gas port in the barrel, propellant gas enters the gas block via the gas port in the barrel. It is directed back through the nozzle into the gas piston cup. High pressure propellant gas impinging on the piston cup pushes it backwards. The piston cup pushes the connecting rod which in turn pushes the operating rod.

Gas vents are located at the limit of the desired operating stroke and they serve to bleed off any excess gas, preventing over-stroking. Little, if any gas ever gets beyond the piston cup. This is part of the self-regulating process. The operating rod is pushed back against the operating spring to deliver a buffered impulse to the bolt carrier which then moves backwards pulling the bolt along the cam pathway and causing it to unlock and begin the extraction cycle.

The operating rod is pushed back into battery by the captive operating spring independent of the bolt carrier motion. In turn it pushes the piston cup shut via the connecting rod and prepares the system for the next operating cycle.

The nozzle assembly may have ribs that scrape the inside of the piston cup with each stroke to loosen the carbon residues that may form deposits in the interior surface of the piston cup. The powdered carbon is then blown out through the vents on the piston cup with each subsequent round fired.

DESCRIPTION OF THE PREFERRED EMBODIMENTS

Figure 1:
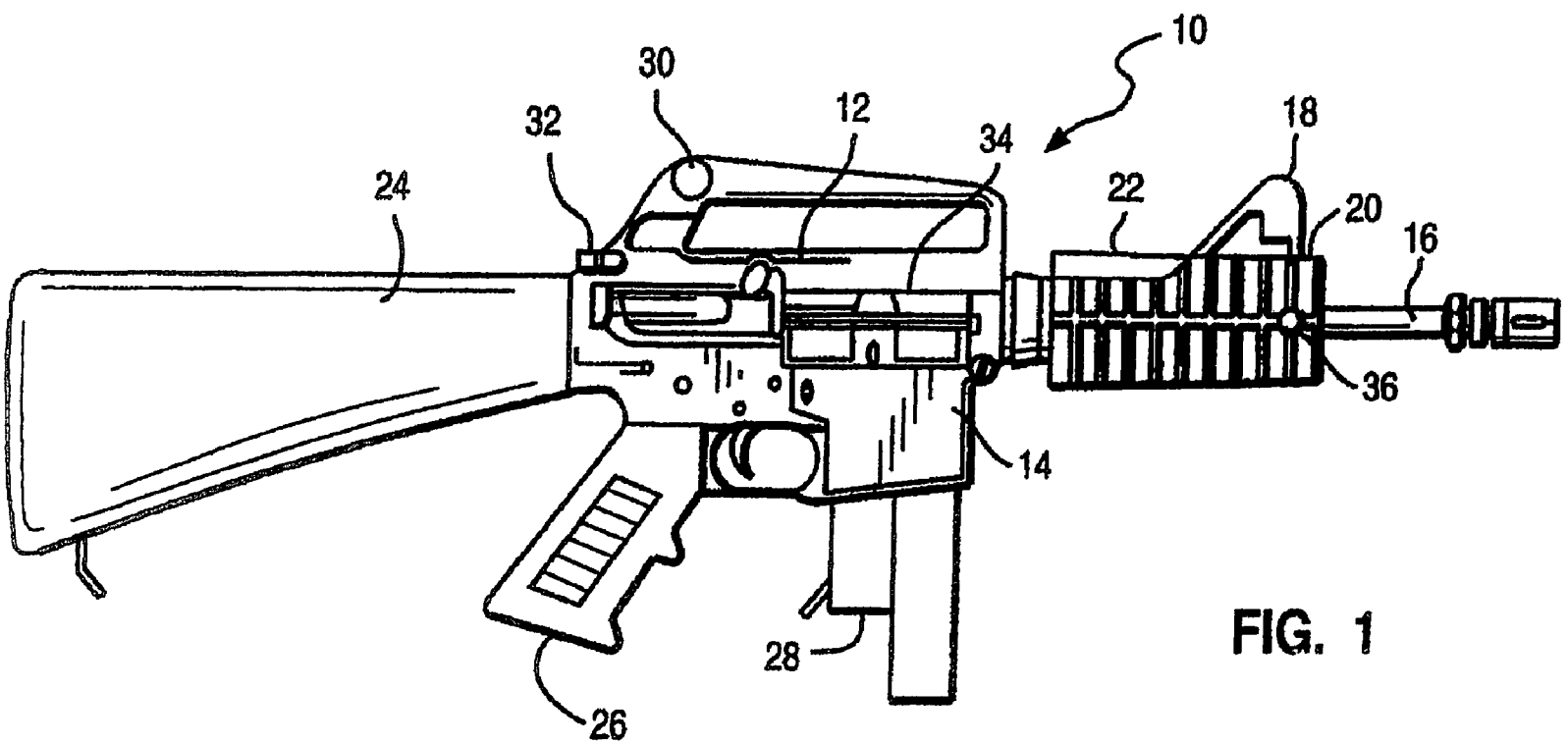
FIG. 1 is a side elevational view of an M16 type of rifle.

Referring now to FIG. 1, which is a side view of an M16 type rifle suitable for conversion to an indirect gas operating system according to the present invention, a rifle 10 consists of an upper receiver 12 pivotally attached to a lower receiver 14 and having a barrel 16 threadedly engaged in the upper receiver 12. Barrel 16 has a front sight assembly 18 securedly attached thereto and is partially enclosed by a pivotable handguard assembly 20. Barrel 16 has a gas port (not shown) passing through the top portion of the barrel from the bore up through the front sight assembly 18 to communicate with a gas piston block 22 lying above and substantially parallel to the barrel.

The upper and lower receivers 12 and 14 respectively, are braced by the buttstock assembly 24, which is threadedly attached to the lower receiver 14 and contains a conventional M16 buffer spring assembly therein. A handgrip 26 is attached to the lower receiver directly behind the trigger assembly. A removable magazine 28 fits in the magazine well of lower receiver 14 and provides a cartridge feeding assembly. A rear sight assembly 30 is adjustably mounted in upper receiver 12. A charging handle 32 is slidably located in upper receiver 12 and also slidably engages bolt assembly 34. The handguard assembly 20 is pivotally mounted to the barrel 16 at pivot pin 36.

Figure 2:
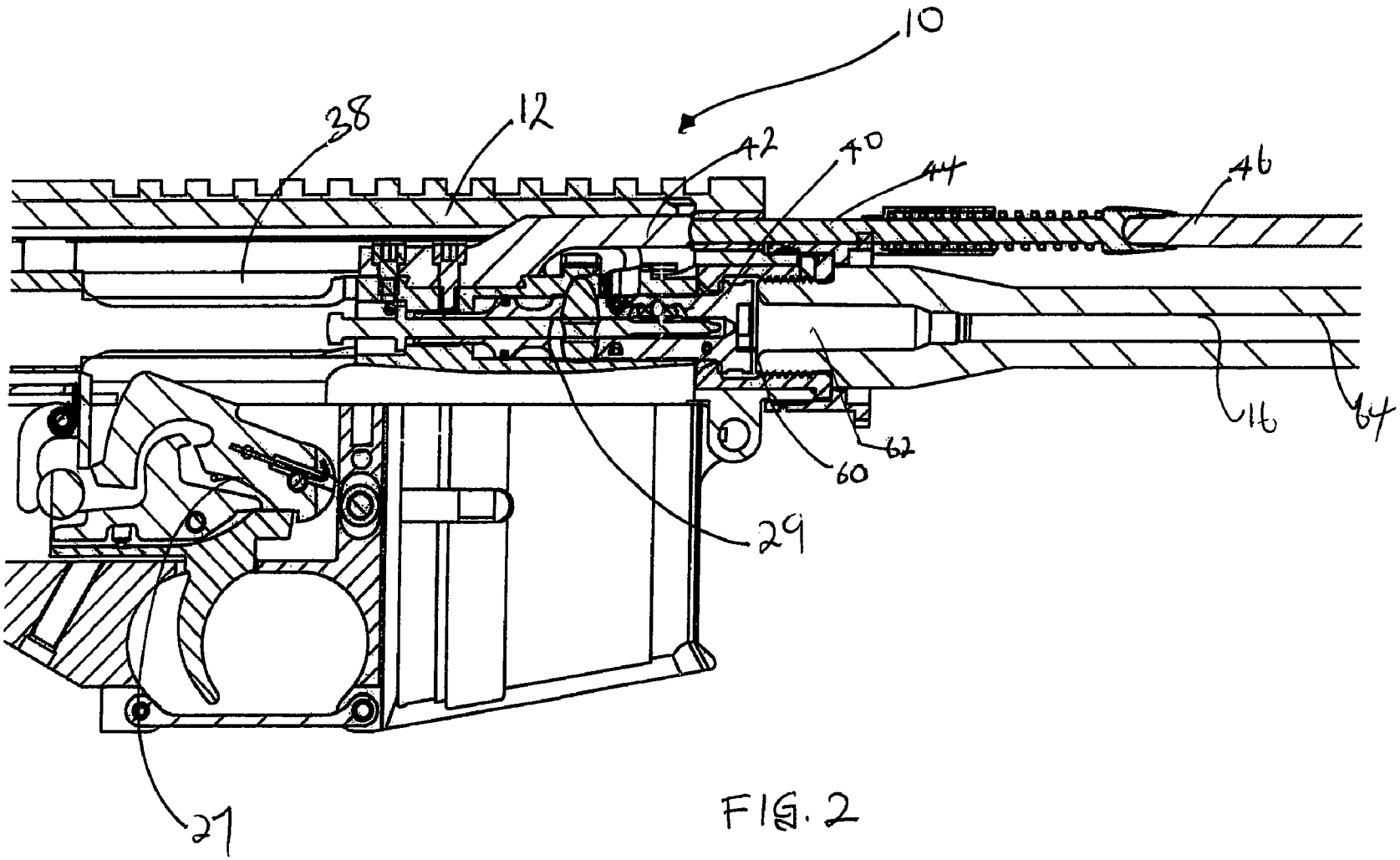
FIG. 2 is a cross-sectional side view of the gas operating system of the rifle of FIG. 1.

Referring now to FIG. 2 which is a partial cross-sectional side view schematic drawing, one preferred embodiment of the rifle assembly 10 is disclosed. In FIG. 2, rifle assembly 10 comprises upper receiver 12 shown in cut-away cross-sectional view, to which is threadably attached barrel assembly 16, and a bolt carrier assembly 38, carrying a bolt 40 therein slidably mounted in receiver 12 and having affixed at the top thereof gas/carrier key 42. Bolt carrier assembly 38 may be of the conventional M16 type adapted to receive a push rod 44 (also called the operating rod), connected to a gas block 22 (See FIG. 3A) via a connecting rod 46; the gas block 22 comprising a nozzle assembly 48 and a piston cup 50 which is in communication with the barrel 16 via a port 52 (See FIG. 12) and a nozzle 54 formed in the nozzle assembly 48. (See FIG. 3A).

Barrel 16 has a breech 60 adapted for locking engagement with bolt 40. A cartridge chamber 62 is formed in breech 60 adapted to receive a standard cartridge. Chamber 62 communicates with rifle bore 64 which is conventionally rifled by button rifling or broach-cut rifling. The breech 60 has locking lugs formed therein to engage with corresponding locking lugs located on the end of bolt 40. The construction of barrel 16 is of a conventional M16 type.

In a typical operation, the rifle assembly 10 as illustrated in FIG. 2 is in the configuration of having a live round loaded in the chamber, with the bolt 40 locked into locking lugs of breech 60. During the firing operation of the rifle, chamber 62 would contain a live, unfired cartridge having a metallic case and a metallic bullet pressed into the case. The M16 rifle is fired utilizing conventional trigger, hammer means 27 and firing pin 29 which results in the ignition of the powder charge in the cartridge in chamber 62 and generation of gas pressures which drive the bullet down bore 64. Bore 64 may be of any conventional rifle design having button rifling or broach-cut rifling. During the firing of the cartridge, bolt 40 is locked into locking lugs 68 of breech 60 by means of conventional bolt rotation caused by camming action between bolt 40 and bolt carrier assembly 38. The bolt remains locked until the bullet passes gas port 52 cut in the barrel wall and communicating with gas nozzle 54. (See FIGS. 11 and 12). This nozzle communicates gas pressures from bore 64 to the piston cup 50, causing piston cup 50 to slide axially away from gas nozzle assembly 48, pushing the connecting rod 46 which in turn pushes the operating rod 44 which in turn pushes back against the operating spring 200 to deliver a buffered impulse on the bolt carrier assembly 38 which then moves backward pulling the bolt 40 along a cam pathway and causing it to unlock and begin the extraction cycle.

Referring now to FIGS. 3A to 3F, the gas operating system 80 and the bolt carrier key (or gas key) 42 assembly is shown. The gas operating system 80 comprises a gas block 22 connected to an operating rod 44 through a connecting rod 46 wherein the operating rod 44 is in striking engagement with the gas key 42. The gas block itself comprises a fixed nozzle assembly 48 nested within a slidable piston cup 50; the nozzle assembly having a nozzle 54 in direct communication with gas port 52 in the rifle bore 64. (See FIG. 12).

Figures 4A, 4B, 4C, 4D, 4E, 4F, 4G, 4H:
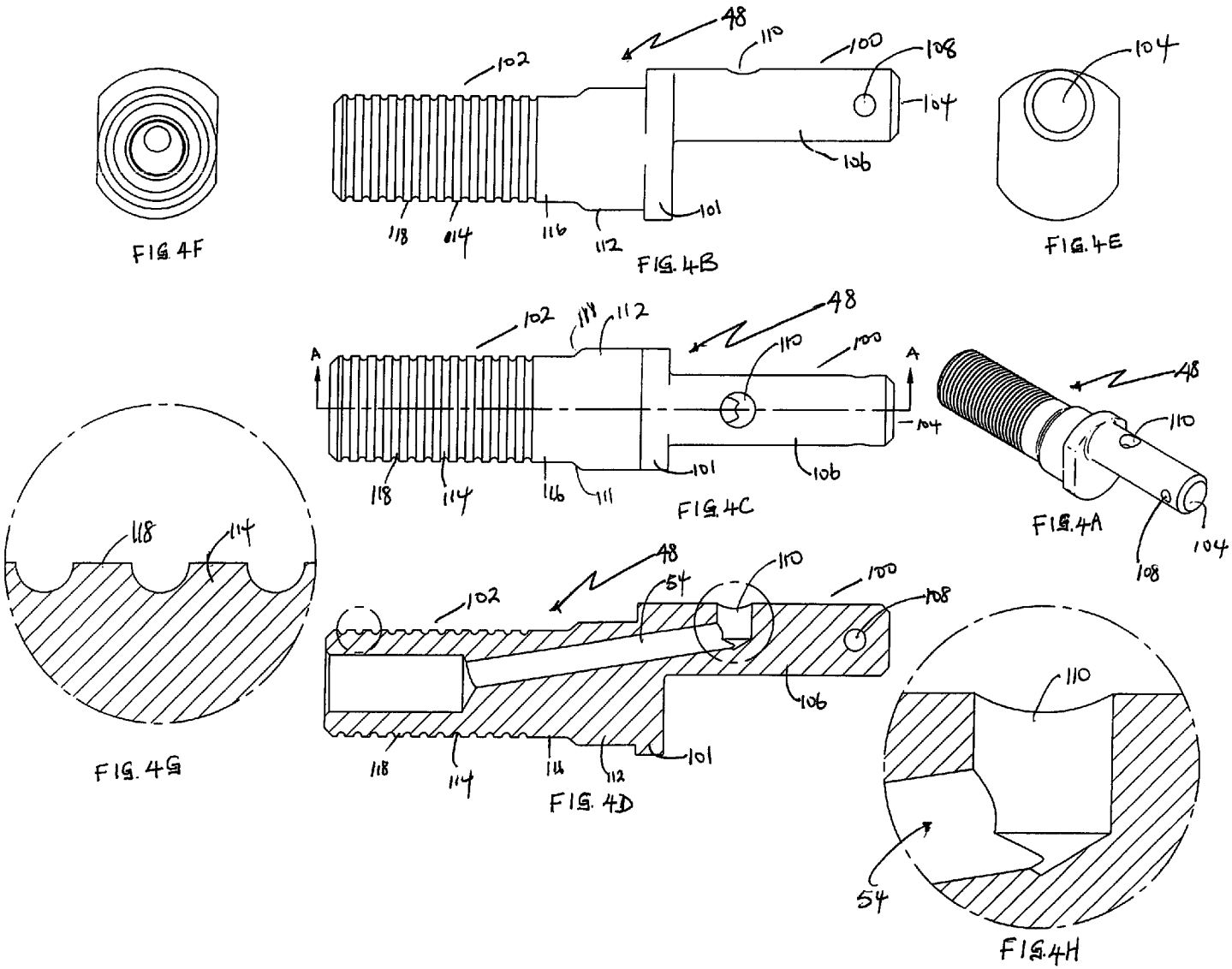
FIG. 4A is a three-dimensional view of the nozzle assembly according to one embodiment of the present invention.
FIG. 4B is a side view of the nozzle assembly.
FIG. 4C is a top-side perspective view of the nozzle assembly.
FIG. 4D is a cross-sectional view of the nozzle assembly along the lines A-A of FIG. 4C.
FIG. 4E is an end view of the proximal end of the nozzle assembly.
FIG. 4F is an end view of the distal end of the nozzle assembly.
FIG. 4G is a detail view of the ribs of the nozzle assembly.
FIG. 4H is a detail view of a section of the nozzle assembly showing how the nozzle communicates with the gas port.

FIGS. 4A to 4H illustrate various views of the nozzle assembly according to one embodiment of the present invention. The nozzle assembly 48 has a cylindrical proximal end 100 connected to a cylindrical distal end 102 via an integral connecting member 101. The connecting member is preferably about 0.10 inches thick. The proximal end 100 of the nozzle assembly 48 has an end wall 104 and a cylindrical wall 106 extending from the end wall to the connecting member 101. In a preferred embodiment, the cylindrical wall 106 is integrally flanged at its junction with the connecting member 101 at a location eccentric to the central axis of the distal end 102 as shown in FIG. 4A. In a preferred embodiment, the end wall 104 is fully radiused at its junction with the cylindrical wall 106 by a 45° radial bevel having a width of about 0.03 inches as shown in FIG. 4C.

Proximate to the end wall 104 of the proximal end 100 of the nozzle assembly 48 is a through pin bore 108 through which a hardened steel pin passes to retain the gas block in place. The cylindrical wall 106 also defines a gas port 110 in direct communication with the barrel gas port 52 of the rifle bore 64 and a nozzle 54 through which the gas pressure in the rifle bore 64 is communicated to the piston cup 50. In a preferred embodiment, the diameter of the pin bore 108 is about 0.077 inches. The diameter of the gas port 110 may be optimized for reliable operation of the bolt 40 depending on the length of the barrel, the size of the ammunition and the placement of the gas block 22. In a preferred embodiment, the diameter of the gas port 110 is about 0.125 inches, and the gas port 110 is placed about 0.250 inches from the connecting member 101. In yet another preferred embodiment, the diameter of the end wall 104 is about 0.294 inches. FIG. 4E is an end view of the proximal end of the nozzle assembly.

The distal end 102 of the nozzle assembly 48 is a hollow or partially hollow cylindrical portion originating from the connecting member 101. In a preferred embodiment, the distal end has a radial flange portion 112 that extends from the connecting member 101 to a diameter-reducing transition portion 111 that connects it to the rest of the cylindrical wall 114 of the distal end 102. In a particularly preferred embodiment, the flange portion 112 extends about 0.294 inches from the connecting member 101. The cylindrical wall 114 preferably terminates in a circumferential 45° bevel, 0.030 inches in width. FIG. 4F is an end view of the distal end 102 of the nozzle assembly 48.

In yet another preferred embodiment, the cylindrical wall 114 of the distal end 102 has a smooth section 116 and a ribbed section 118. The ribs may comprise radial knurls such as shown in FIG. 4G, and comprise, in a preferred embodiment, alternating semi-circular depressions interspersed with radially extending ridges as shown in FIG. 4G.

As shown in FIG. 4D, extending between the interior of the proximal end 100 and the hollow interior of the distal end 102 of the nozzle assembly 48 is the gas nozzle 54 in direct communication with the gas port 110. In a preferred embodiment, the gas nozzle 54 is a hollow tube of approximately 0.125 inches in diameter angularly disposed in the interior portion of the nozzle assembly 48 and extending from the gas port 110 up to the hollow interior of the distal end, preferably about 0.50 inches from the tip of the distal end 102.

Figure 5A:
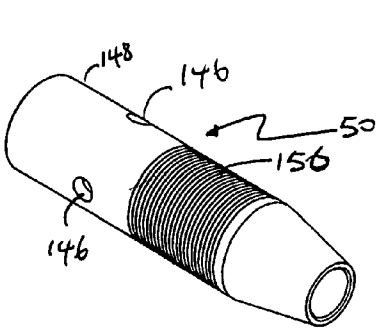
FIG. 5A is a three-dimensional view of the piston cup according to one embodiment of the present invention.
Figure 5E:
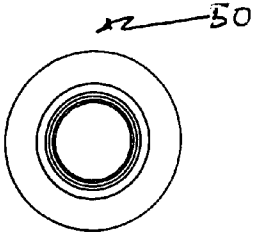
FIG. 5E is an end view of the distal end of the piston cup.
Figure 5D:
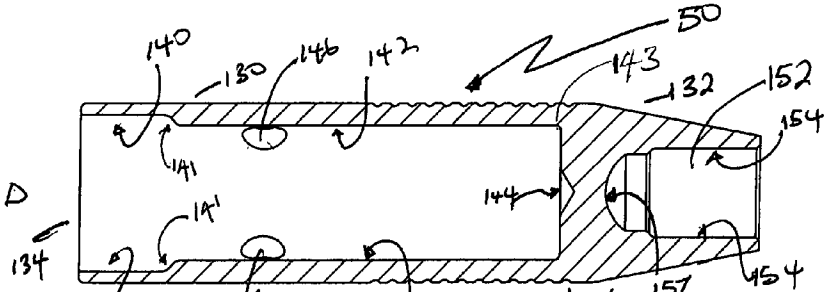
FIG. 5D is a cross-sectional view of the piston cup along the lines A-A of FIG. 5C.
Figure 5C:
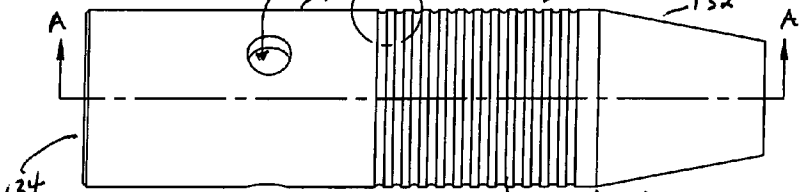
FIG. 5C is another side perspective view of the piston cup.
Figure 5B:
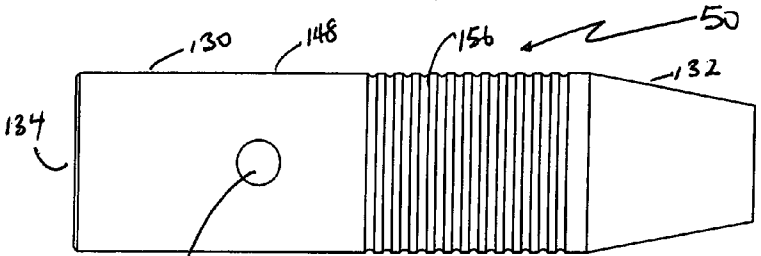
FIG. 5B is a side view of the piston cup.
Figure 5G:
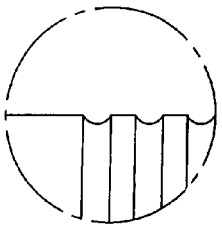
FIG. 5G is a detail view of the ribs of the piston cup.
Figure 5F:
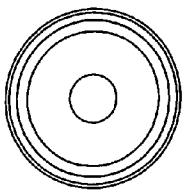
FIG. 5F is an end view of the proximal end of the piston cup.

FIGS. 5A-G illustrate the piston cup 50 according to one embodiment of the present invention. The piston cup has a proximal end 130 and a distal end 132, the end views of which are shown in FIGS. 5F and 5E respectively.

The proximal end 130 of the piston cup 50 has a hollow cylindrical portion extending about 1.5 inches, in a preferred embodiment, from its open end 134 to its junction 136 with the distal end 132. As shown in FIG. 5D, the interior of the proximal end 132 defines a first portion 140 having an internal diameter greater than a second portion 142 and having cylindrical wall thicknesses reduced proportionally as illustrated in FIG. 5D, and wherein the junction between the first portion 140 and the second portion 142 defines a bevel 141. In a preferred embodiment, the diameter of the first portion 140 is about 0.436 inches and the diameter of the second portion 142 is about 0.375 inches, with the first portion 140 extending about 0.237 inches from the end 134 of the proximal end and radiused into the second portion 142 with a 0.030 inch by 45° bevel 141 as shown in FIG. 5D. The interior of the second portion 142 extends up to an end wall 144 at junction 136, and is also preferably radiused at its junction 143 with the end wall 144 with about 0.015 inch by 45° bevel as shown in FIG. 5D. The nozzle assembly 48 is nested within the piston cup 50 such that the bevel 111 on the nozzle assembly mates against the bevel 141 of the interior portion of the piston cup 50, until the axial movement of the piston cup 50 upon firing of the weapon is vented via at least one vent 146 formed on the wall of the second portion 142. The vent 146 is preferably a bore of about 0.125 inches in diameter and defines the limit of the operating stroke, serving to bleed off excess gas, thereby preventing over stroking. Little, if any gas ever gets beyond the piston cup 50 and this is part of the self-regulating process of the present invention. In a preferred embodiment, the piston cup 50 has two vents 146 disposed along the same radial line and spaced about 180 degrees apart. In a most preferred embodiment, the piston cup has three vents 146 disposed along the same radial line and spaced about 120 degrees apart.

Operationally, the distal end 100 of the nozzle assembly 48 is nested into the hollow cylindrical portion of the proximal end 130 of the piston cup 50 such that the flange 112 of the distal end 102 of the nozzle assembly 48 is in mating engagement with the interior walls of the first portion 140 of the proximal end 130 of the piston cup 50. The reciprocal displacement of the piston cup 50 rubs against the knurls/ridges 118 of the nozzle assembly 48 which scrapes burnt propellant buildup off the walls of the piston cup and vents it out through vent ports 146.

The nozzle assembly 48 and the piston cup 50 are preferably made of similar metal such as steel or stainless steel and are finished in a smooth polished exterior, with the nozzle assembly sized for relatively snug-fitting engagement in piston cup 50, sufficient to allow the piston cup to slide without extreme friction, but tight enough to provide a relatively good gas-tight seal of the nozzle assembly 48 against the cylindrical walls of the piston cup 50.

In one embodiment, the outer wall 148 of the second portion 142 of the proximal end 130 of the piston cup 50 has radial knurls 156 defined by alternating depressions and ridges as illustrated in FIG. 5G. The knurled portion can extend substantially along the length of the proximal end and is designed to provide a grippable surface for ease of disassembly.

The distal end 132 of the piston cup 50 preferably defines a substantially conical section sloping about 110° extending from the junction 136 to an open end having an opening of about 0.25 inches in diameter in a preferred embodiment. As shown in FIG. 5D, the distal end 132 of the piston cup 50 defines a connecting rod receiving bore 152 comprising a first cylindrical portion 154 that is radiused into a second cylindrical portion 157, said second cylindrical portion being of smaller diameter than the first cylindrical portion and ending in a semi-hemispherical cavity 157 formed in the end wall 144. The connecting rod receiving bore 152 is not in any communication with the end wall 144 of the interior portion 142 of the proximal end of the piston cup 50.

The length of piston cup 50 varies depending upon the amount of stroke needed to completely cycle the bolt carrier and bolt assembly backward in the receiver sufficiently to eject a fired cartridge and to load a new unfired cartridge into chamber 44. In one preferred embodiment of the invention, the piston cup 50 has a length of 1.95 inches from tip to tip and a stroke length defined by the placement of the vent ports 146 of about 0.528 inches. In this same preferred embodiment, the proximal end 102 of the nozzle assembly 48 has a total axial length of about 1.130 inches.

One challenge is to make the parts very light. If the walls of the piston cup are thin enough, they will heat up in protracted fire so propellant gunk will burn off rather than build up. Too thin, though, and the walls will rupture. The connecting rod and the operating rod are preferably to be kept light too. In a preferred embodiment, the thinnest section of the piston cup, namely the first portion 140 of the proximal end 130 of the piston cup 50 is about 0.10 inches.

Figures 6A, 6B, 6C, 6D, 6E:
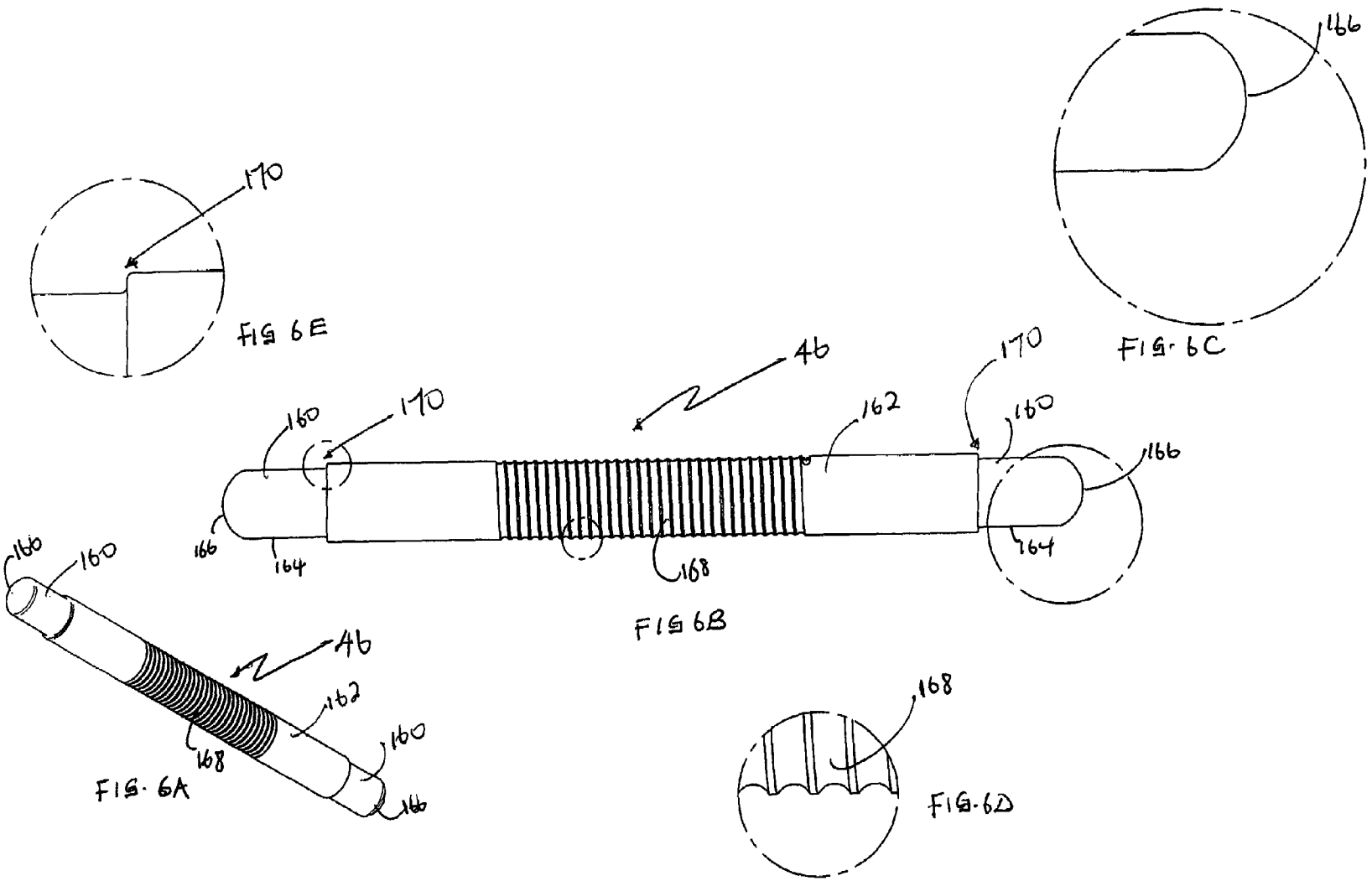
FIG. 6A is a three dimensional view of the connecting rod.
FIG. 6B is a side perspective view of the connecting rod.
FIGS. 6C-6E are detail views of portions of the connecting rod.

Referring now to FIGS. 6A to 6E, the connecting rod 46 comprises two similar ends 160 integrally joined by a solid cylindrical midsection 162 such that the diameter of the midsection 162 is greater than the diameter of the ends 160. Each end 160 defines a solid cylindrical portion 164 integrally capped off by a semi-hemispherical tip 166 that is preferably sized and configured for mating engagement with the semi-hemispherical cavity in the wall of the second cylindrical portion 157 of the connecting rod receiving bore 152 of the piston cup 50. In a particularly preferred embodiment, the midsection has knurls 168, the details of which are shown in FIG. 6E. In a preferred embodiment, the length of the midsection 162 is about 2.55 inches and has a diameter 0.245 inches compared to 0.216 inches of the ends 160. Also, in a preferred embodiment, the junctions 170 of the midsection 162 and the ends 160 of the connecting rod 46 are radiused with about 0.005 inch 450 bevel.

One end 160 of the connecting rod is sized and configured to engage the distal end 132 of the piston cup such that the tip 166 mates against the semi-hemispherical cylindrical wall portion 157 of the connecting rod receiving bore 152 and the cylindrical walls 154 of the connecting rod receiving bore 152 forms a substantially tight fitting engagement with the walls of the midsection 162. The other end of the connecting rod plugs into the proximal end 180 of the operating rod 44 as described below and in substantially the same manner as it plugs into the distal end 132 of the piston cup 50. The connecting rod 46 couples the piston cup 50 and the operating rod 44 such that when assembled, the gas operating system of the present invention functions substantially as a single piece but is nevertheless easily disassembled by the stepped arrangement of the ends 160 of the connecting rod 46 that allows a degree of lateral movement once a step is cleared.

Figures 7A, 7B, 7C, 7D, 7E, 7F, 7G:
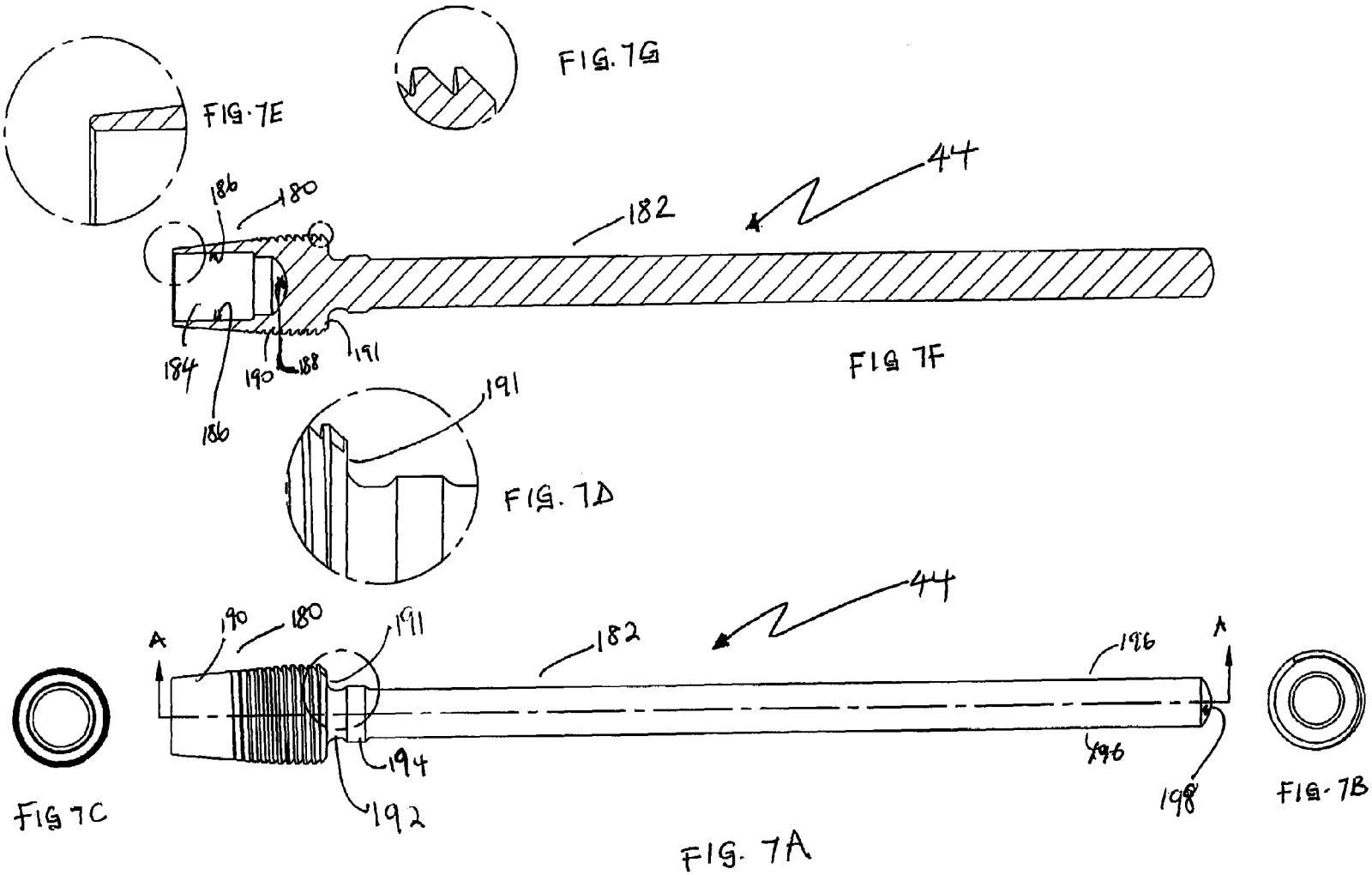
FIG. 7A is a side view of an operating rod.
FIG. 7B is an end view of the distal end of the operating rod.
FIG. 7C is an end view of the proximal end of the operating rod.
FIGS. 7D, 7E and 7G are detail views of portions of the operating rod.
FIG. 7F is a sectional view of the operating rod along lines A-A of FIG. 7A.

Referring now to FIGS. 7A to 7G, the operating rod 44 comprises a proximal end 180 and a distal end 182. In a preferred embodiment, the proximal end 180 of the operating rod 44 is tapered as shown in FIG. 7A and has an external wall 190 and an end wall 191. In another preferred embodiment, the external wall 190 is knurled. As shown in FIG. 7F, the proximal end 180 of the operating rod 44 defines a connecting rod receiving bore 184 having a first cylindrical wall portion 186 that is radiused into a second cylindrical wall portion 188 having a smaller diameter than the first portion 186 and ending in a semi-hemispherical end wall, and is sized and configured to receive one end 160 of the connecting rod. When engaged, the tip 166 of the connecting rod 46 preferably mates against the semi-hemispherical end of the second cylindrical wall portion 188 of the operating rod 44 and the cylindrical side walls 186 of the connecting rod receiving bore 184 of the operating rod 44 form a substantially tight fitting engagement with the walls of the midsection 162 of the connecting rod 46.

As shown in FIG. 7A, the distal end 182 of a preferred embodiment of the operating rod is a solid cylindrical rod extending from end wall 191 of the proximal end 180 via a neck 192 followed by a flange 194 and extending to a convex tip 198 adjoining the cylindrical wall 196. In a preferred embodiment, the tip 198 is radiused with a 0.125 inch radii and measures about 0.0385 inches from the end of the cylindrical wall 196. In another preferred embodiment, the operating rod's distal end 182 has the same diameter as the original gas tube of the AR15, so it easily passes into the upper receiver and enters the bolt carrier key 42.

Figures 3A, 3B, 3C, 3D:
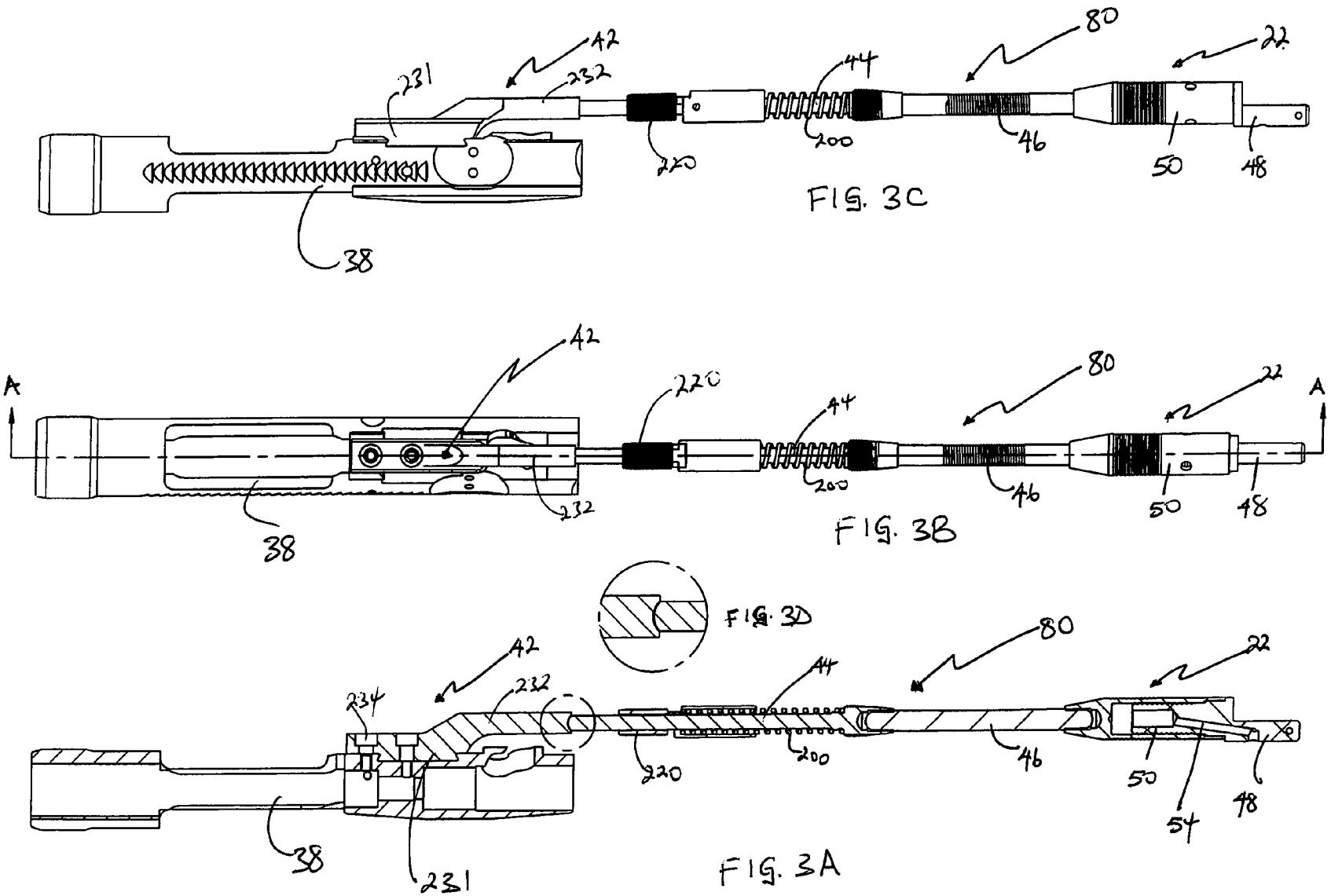
FIG. 3A is a sectional view of the gas key and gas operating system along lines A-A of FIG. 3B.
FIG. 3B is a side view of the gas key and gas operating system.
FIG. 3C is a sectional view along lines A-A of the gas key and gas operating system of the present invention.
FIG. 3D is a detailed view of operating rod/gas key engagement.

As shown in FIGS. 3A to 3C, the gas operating system 80 is preferably spring loaded and this may be accomplished by placing a captive operating spring 200 on the cylindrical wall 196 of the distal end 182 of the operating rod 44 such that one end of the spring rests on the neck 192 between the flange 194 and the end wall 191 of the proximal end 180 of the operating rod 44. The other end of the operating spring 200 is retained by a spring cup 201 an embodiment of which is shown in FIGS. 8A to 8G.

As shown in FIGS. 8A to 8G, the spring cup 200 is a hollow cylindrical cup having a sleeve 202 inserted into it, the sleeve defining a spring seat 204 and a lip 206 for accommodating the spring; the cup further having a through bore 208 through which the distal end 182 of the operating rod 44 passes. Optionally disposed on the cylindrical side wall 210 of the spring cup 200 is a pressure relieving bore 212 designed to allow passage of moisture and through which a small pin may be inserted to keep the spring cup in place. Also, optionally disposed at the end of the spring cup 200 opposite the spring retaining portion is an integrally machined bushing separator 214 for those embodiments where it is desirable to have a bushing 220 riding on the operating rod as shown in FIG. 2A.

Figure 9B:
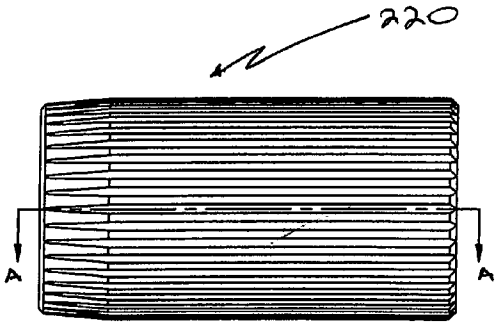
FIG. 9B is a side view of the bushing.
Figure 9C:
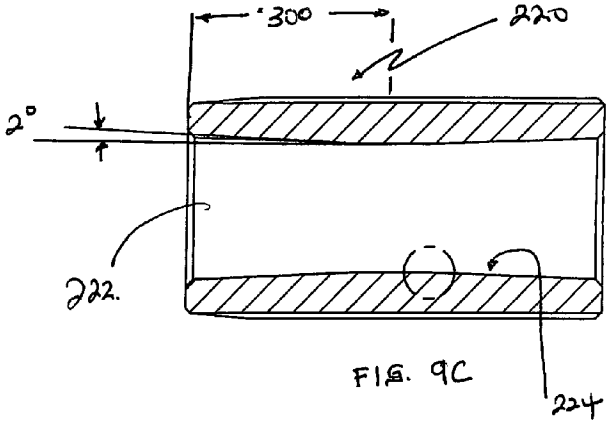
FIG. 9C is a sectional view of the bushing along lines A-A of FIG. 9B.
Figure 9E:
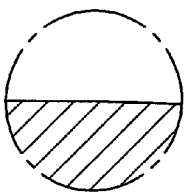
FIG. 9E is a detail view of a portion of the bushing.
Figure 9D:
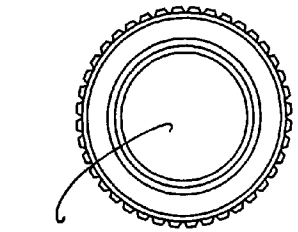
FIG. 9D is an end view of the bushing.
Figure 9A:
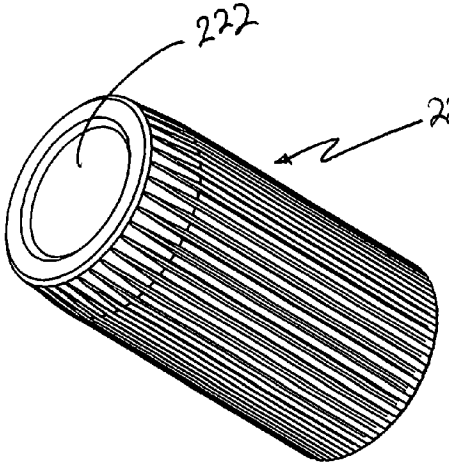
FIG. 9A is a three dimensional view of a bushing according to one embodiment of the present invention.
Figures 8A, 8B, 8C, 8D, 8E, 8F:
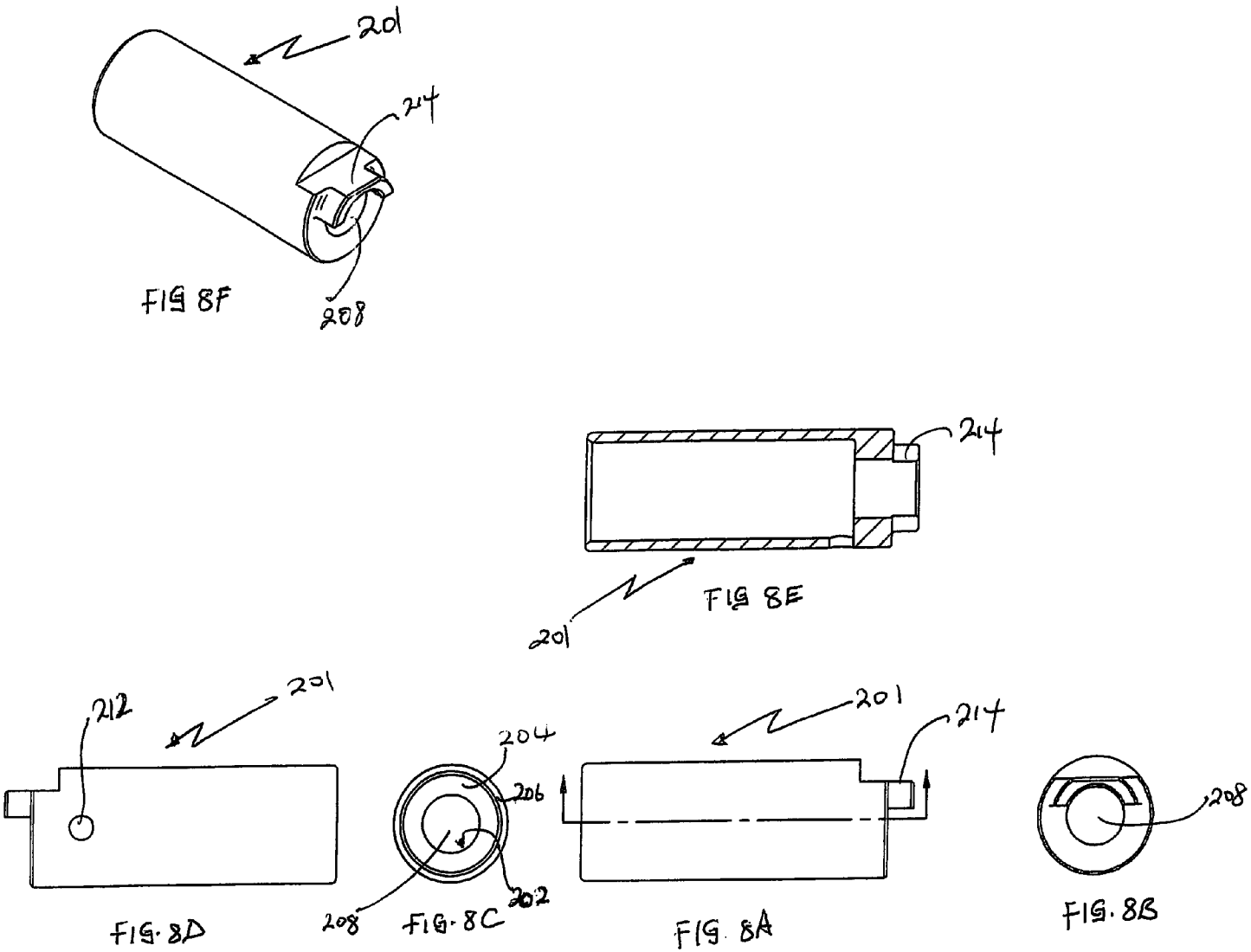
FIGS. 8A and 8D are side perspective views of a spring cup according to one embodiment of the invention.
FIG. 8B is an end view of the bushing separator end of the spring cup.
FIG. 8C is an end view of the spring-retaining end of the spring cup.
FIG. 8E is a cross-sectional view of the spring cup along sides A-A of FIG. 8A.
FIG. 8F is a three-dimensional view of the spring cup.

Referring to FIGS. 9A-9E, an operating rod bushing 220 is preferably included to ensure consistent centering of the operating rod on the strike face of the bolt carrier key. The operating rod bushing 220, according to one embodiment of the present invention is preferably a hollow cylindrical body having fine pitch knurls axially disposed on its outer wall and having a bore 222 defined by inner walls 224 through which the operating rod passes wherein the bore 222 is slightly constricted at its midsection for tight engagement with the operating rod 44. In a preferred embodiment, the constriction of the mid section of the bore 222 defines an angle of 2° with the longitudinal axis of the inner walls 224 as shown in FIG. 9C.

Many previous attempts to provide reliable gas operating system for the AR-15/M-16 weapon system have suffered from dynamic problems related to off-center impact of the bolt carrier which causes the carrier to lift initially before moving backwards. This lift at the front of the carrier causes a corresponding dip at the rear of the carrier which causes the carrier to strike the lower receiver extension and cause excessive wear.

By redirecting the energy imparted by the operating rod to the bolt carrier by inducing a negative lift and therefore neutral transfer, the gas operating system of the present invention ensures that the bolt carrier moves only in a linear direction. This is achieved by off-setting the operating rod and modified gas key (which the operating rod strikes) by a pre-determined angle. The result is that the gas operating system of the present invention does not induce the wear characterized by previous attempts at modifying the direct gas impingement system of the AR15/M16 weapon.

The gas operating system of the present invention uses a modified bolt carrier key 42 shown in FIGS. 10A to 10G attached to a conventional M-16 direct gas operated type bolt carrier assembly 38. See FIG. 2. Bolt carrier assembly 38 has a bolt carriage frame or carrier on top of which is attached a carrier key 42 having a base portion 230 and an elongate striking portion 232. The base portion 230 is attached via the fastener holes 234 to the carrier assembly. The striking portion 232 is struck by the operating rod at the strike face 236 shown in detail in FIG. 10 F. The strike face 236 is concave shaped by an inwardly directed arc sized and configured to cradle the convex tip 198 of the operating rod 44. In a preferred embodiment, the arc defines a depth of 0.035 plus/minus 0.003 inches.

Figures 10A, 10B, 10C, 10D, 10E, 10F, 10G, 10H:
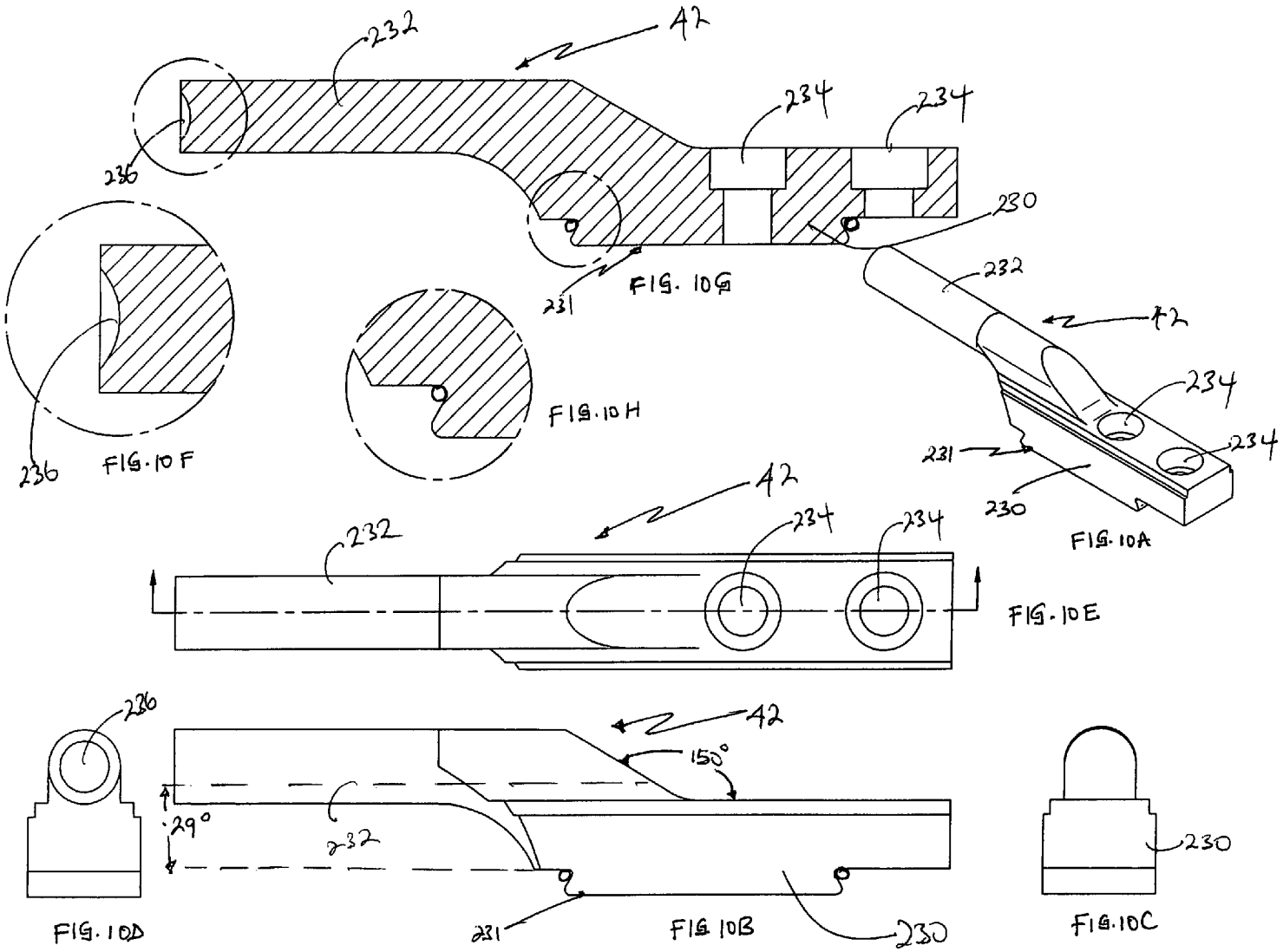
FIG. 10A is a three dimensional view of the bolt carrier key according to one embodiment of the present invention.
FIG. 10B is a side view of the carrier key.
FIG. 10C is the non-striking end view of the carrier key.
FIG. 10D is the striking end view of the carrier key.
FIG. 10E is a top perspective view of the carrier key.
FIG. 10F is a detail view of the striking end of the carrier key.
FIG. 10G is a sectional view of the carrier key along lines A-A of FIG. 10E.
FIG. 10H is a detail view of a portion of the carrier key.

As seen in FIG. 3A, strike face 236 of the carrier key is located to be substantially coaxial with the operating rod 44. However, in order to off-set the off center impact of the bolt carrier, the longitudinal axis of the striking portion 232 is slightly offset, preferably by an angle of −0.29° plus or minus 0.02°, from being parallel to the longitudinal axis of the base portion 230 as shown in FIG. 10B. In that way, the striking portion 232 is suitably shaped to direct loads imparted by operating rod 44 into the base 230 that engages the striking portion 232 to the carrier frame. The base portion 230 defines a fastener hole or channel 234 through which the gas key 42 is fastened to the bolt carrier assembly 38.

Additionally, the base portion 230 of the carrier key 42 is preferably precision machined with a carrier-key dovetail 231 (See FIG. 10G) sized and configured to rigidly interlace with a corresponding precision cut on the bolt carrier assembly 38. (See FIG. 2.) Unlike carrier keys fastened merely by screws which may allow some lateral movement, the preferred carrier key configuration of the instant invention in precisely put in position by means of the dovetail and fasteners to deflect impact forces.

The entire gas operating system 80 of the present invention is made of conventional material, preferably hard structural material such as steel or stainless steel, and is incorporated into autoloading firearms by conventional means.

Knurls are turned into the various sections of the gas operating system 80 to reduce weight and give crud someplace to collect until the rifleman has time to take it out and clean it, and to form a grippable surface for ease of disassembly and reassembly.

Pressure at the gas port rises quickly when the bullet passes the port, and it begins to drop after pressures in the barrel and gas cylinder equalize. The barrel's gas port must be far enough from the breech to allow pressures to fall to safe levels before the breech begins to open. The main way to influence this timing is to adjust the distance from the breech to the gas port. For rifles, the distance is usually at least 10 inches or 25 centimeters. Breech opening can be delayed further through mechanical disadvantage, free travel in unlocking mechanisms, recoil dampers, bolt mass, and so on. Since the gas operating system of this invention requires less gas pressure to reliably cycle the bolt than is typically supplied by the powder detonation, the "unneeded" gas and related residue, which would be blow back into the AR's action, is expelled via the vent ports in the piston cup. Chamber pressures remain unaffected by the gas operating system of the present invention.

In prior attempts at indirect gas impingement systems for the AR 15 system, barrel lengths of less than 16 inches are reliant upon proper gas port setup and proper ammunition selection. Short gas tube systems typically require slightly oversized gas ports for reliable feeding and extraction. Use of heavier bullets with short-barreled rifles also increases the reliability of function from 14.5 inches and shorter rifles. Heavier bullets are moving slightly slower and remain in the barrel long enough to develop the pressure necessary to reliably operate the gas operating system. Lighter bullets generally exit the barrel too quickly to guarantee high enough pressure to reliably operate the gas operating system. However, the gas operating system of the present invention is adaptable to all sorts of barrel lengths and bullets sizes because it is designed to not only use less gas but to use just enough of what is needed to cycle the bolt and is a substantial improvement over existing indirect gas operating systems.

The vent holes 146 are 120 degrees apart along a radial line in a preferred embodiment; gas is vented forward towards the front sight over the gas block, the vent holes serve to stop the piston travel and allow outflow of gas some of which will come into contact with the barrel surface. As the area is highly ventilated with massive airflow if a rail system is fitted, there is no greater temperature build up in that area than with a direct impingement system. In fact, when measured, the area typically runs cooler with the gas operating system of this invention.

Figure 11:
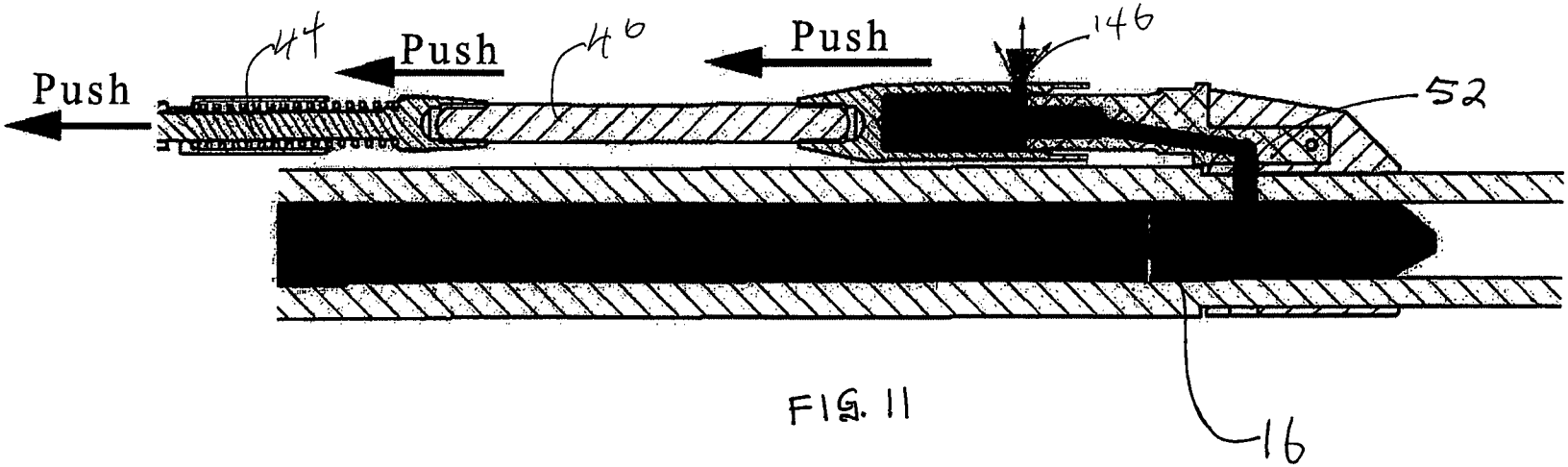
FIG. 11 is a schematic of the extraction cycle of the operation of the gas operating system.
Figure 12:
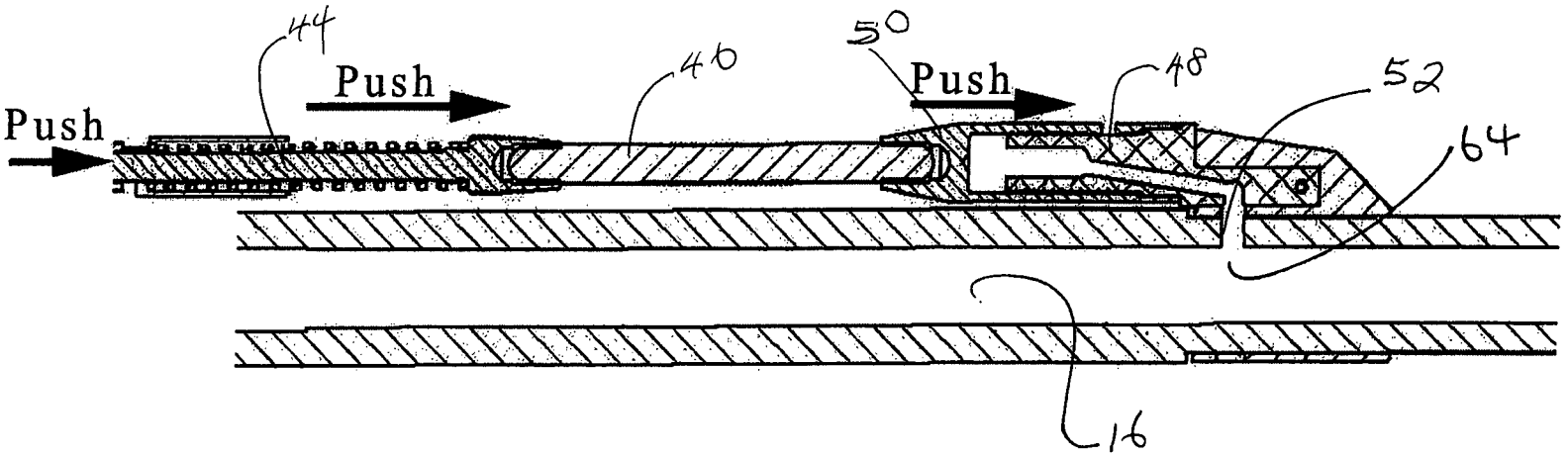
FIG. 12 is a schematic of the return cycle of the operation of the gas operating system.

Referring to FIGS. 11 and 12, the process starts with the ignition of cartridge liberating propellant gases which propel the bullet down the barrel. As the bullet passes, the gas port 52 in the barrel, propellant gas enters the gas block via the gas port in the barrel. It is directed back through the nozzle contained in the nozzle assembly 48 into the piston cup 50. High pressure propellant gas impinging on the piston cup pushes it backwards. The piston cup pushes the connecting rod 46 which in turn pushes the operating rod 44.

Gas vents 146 are located at the limit of the desired operating stroke and they serve to bleed off any excess gas, preventing over-stroking. Little, if any gas ever gets beyond the piston cup. This is part of the self-regulating process. The operating rod is pushed back against the operating spring 200 to deliver a buffered impulse to the bolt carrier which then moves backwards pulling the bolt along the cam pathway and causing it to unlock and begin the extraction cycle.

The bolt carrier, having more mass than the operating rod, keeps going rearward. The operating rod runs out of gas, so to speak, and its return spring pushes it home again. As shown in FIG. 12, the operating rod is pushed back into battery by the captive operating spring 200 independent of the bolt carrier motion. In turn it pushes the piston cup 50 shut via the connecting rod 46 and prepares the system for the next operating cycle.

The connecting rod 46 guides the operating rod back home; only a millimeter or two of the operating rod's travel will not be guided by the intermediate rod, so there will be no need of a tube or rail to guide the operating rod.

When the shooting day is ended, the operator can simply disassemble the connecting rod 46 from the operating rod 44 and the gas block 22 and clean the parts off.

Reassembly is Reverse of Disassembly.

The present invention, by eliminating the necessity for gas pressure in the rifle's receiver area, and by restricting the gas passage to the piston cup has eliminated a major source of fouling and resultant jamming in the rifle's operating mechanism. Also, elimination of the gas operating system in the receiver area has allowed the elimination of the conventional gas piston rings on the bolt inside the bolt carrier, which eliminates a large source of friction and resistance therebetween. This allows an easier cycling of the rifle system and less shock and less wear and tear on the rifle's moving components.

Although a specific preferred embodiment of the present invention has been described in the detailed description above, the description is not intended to limit the invention to the particular forms or embodiments disclosed therein since they are to be recognized as illustrative rather than restrictive and it would be obvious to those skilled in the art that the invention is not so limited. For example, the size of the nozzle and the piston cup or the length of the connecting rod may be modified to cover different cartridge sizes and barrel length. Thus, the invention is declared to cover all changes and modifications of the specific example of the invention herein disclosed for the purposes of illustration which do not constitute departure from the spirit and scope of the invention. The drawings are for illustration purposes only and are not necessarily drawn to scale. Further, all references cited herein are incorporated in this specification by reference.

The invention claimed is:

1. A gas operating system for an autoloading firearm having a bolt carrier assembly comprising; a nozzle assembly having a nozzle in direct communication with a port on the muzzle; said nozzle assembly nested within a piston cup having a vent, a connecting rod operationally linking the piston cup to a spring loaded operation rod which is substantially co-axial to a bolt carrier key having a base portion and a striking portion, said striking portion having a external, concave strike face which is transverse to the longitudinal path of the bolt carrier key and is in operational contact with said operating rod.

2. The gas operating system of claim 1, wherein the piston cup has at least three circular vent holes equidistant from each other along the same radial line.

3. The gas operating system of claim 1, wherein the nozzle assembly having knurls about its exterior scrapes burnt propellant residue off the internal walls of the piston cup upon the reciprocal displacement of the piston cup.

4. The gas operating system of claim 1, wherein the nozzle of the nozzle assembly is angularly disposed within the nozzle assembly.

5. The gas operating system of claim 1, wherein the connecting rod comprises two similar ends integrally joined by a solid cylindrical midsection such that the diameter of the midsection is greater than the diameter of the ends, each end defining a solid cylindrical portion integrally capped off by a semi-hemispherical tip, each sized and configured for mating engagement with a connecting rod receiving bore on the piston cup and on the operating rod respectively.

6. The gas operating system of claim 4, wherein the midsection of the connecting rod is knurled.

7. The gas operating system of claim 1, wherein the spring loaded operating rod comprises a spring retained by a spring cup.

8. The gas operating system of claim 7, further comprising a bushing disposed on said operating rod adjacent to the spring cup.

9. The gas operating system of claim 1, wherein the longitudinal axis of the striking portion of the carrier key is angularly offset from being parallel to the longitudinal axis of the base portion of the carrier key.

10. The gas operating system of claim 9, wherein the angle of offset is in the range from about −0.27' to about −0.31'.

11. The gas operating system of claim 1, wherein the base portion of the carrier key dovetails into a corresponding interlacing portion on the bolt carrier assembly.

12. A gas operating system for an autoloading firearm comprising: a bolt, a bolt carrier assembly configured to receive said bolt, a bolt carrier key having a striking portion and a base portion attached to said bolt carrier assembly; a nozzle assembly having a nozzle in direct communication with a port on the muzzle; said nozzle assembly nested within a piston cup having a vent; a connecting rod operationally linking the piston cup to a spring loaded operating rod which is substantially co-axial to the bolt carrier key, said striking portion of the bolt carrier key having a concave strike face in operational contact with said operating rod, wherein gas discharged from a fired cartridge displaces the piston cup and causes the operating rod to strike the strike face of the bolt carrier key displacing the bolt.

13. The gas operating system of claim 12, wherein the piston cup has Fee at least three circular vent holes equidistant from each other along the same radial line.

14. The gas operating system of claim 12, wherein the nozzle assembly having knurls about its exterior scrapes burnt propellant residue off the internal walls of the piston cup upon the reciprocal displacement of the piston cup.

15. The gas operating system of claim 12, wherein the nozzle of the nozzle assembly is angularly disposed within the nozzle assembly.

16. The gas operating system of claim 12, wherein the connecting rod comprises two similar ends integrally joined by a solid cylindrical midsection such that the diameter of the midsection is greater than the diameter of the ends, each end defining a solid cylindrical portion integrally capped off by a semi-hemispherical tip, each end sized and configured for mating engagement with a connecting rod receiving bore on the piston cup and on the operating rod respectively.

17. The gas operating system of claim 12, wherein the midsection of the connecting rod is knurled.

18. The gas operating system of claim 12, wherein the spring loaded operating rod comprises a spring retained by a spring cup.

19. The gas operating system of claim 12, further comprising a bushing disposed on said operating rod adjacent to the spring cup.

20. The gas operating system of claim 12, wherein the longitudinal axis of the striking portion of the carrier key is angularly offset from being parallel to the longitudinal axis of the base portion of the carrier key.

21. The gas operating system of claim 20, wherein the angle of offset is in the range from about −0.27 O to about −0.31 O.

22. The gas operating system of claim 12, wherein the base portion of the carrier key dovetails into a corresponding interlacing portion on the bolt carrier assembly.

23. An autoloading firearm comprising the gas operating system of claim 12.

24. The gas operating system of claim 23, wherein the piston cup has fee at least three circular vent holes equidistant from each other along the same radial line.

25. The gas operating system of claim 23, wherein the nozzle assembly having knurls about its exterior scrapes burnt propellant residue off the internal walls of the piston cup upon the reciprocal displacement of the piston cup.

26. The autoloading firearm of claim 23, wherein the base portion of the carrier key dovetails into a corresponding interlacing portion on the bolt carrier assembly.

27. The autoloading firearm of claim 23, wherein the longitudinal axis of the striking portion of the carrier key is angularly offset from being parallel to the longitudinal axis of the base portion of the carrier key.

28. The autoloading firearm of claim 27, wherein the angle of offset is in the range from about −0.27 O to about −0.31 O.

* * * * *